United States Patent [19]

Kanda et al.

[11] 4,069,800

[45] Jan. 24, 1978

[54] FUEL INJECTION APPARATUS

[75] Inventors: Fumio Kanda; Nobuhiro Kaibara; Seibi Ohki; Kazuo Okamoto; Akira Suzuki, all of Higashi Matsuyama, Japan

[73] Assignee: Diesel Kiki Co., Ltd., Tokyo, Japan

[21] Appl. No.: 651,855

[22] Filed: Jan. 23, 1976

[30] Foreign Application Priority Data

Jan. 24, 1975 Japan ..... 50-9827

[51] Int. Cl.[2] ..... F02M 39/00

[52] U.S. Cl. ..... 123/139 A; 123/139 E

[58] Field of Search ..... 123/139 R, 139 A, 139 AS, 123/139 AT, 139 DP, 139 E

[56] References Cited

U.S. PATENT DOCUMENTS

| | | | |
|---|---|---|---|
| 3,796,206 | 3/1974 | Links | 123/139 E |
| 3,810,453 | 5/1974 | Wolfe | 123/139 R |
| 3,921,604 | 11/1975 | Links | 123/139 E |

*Primary Examiner*—Samuel Feinberg
*Attorney, Agent, or Firm*—Edward F. Connors

[57] ABSTRACT

A servo piston is driven to compress fuel in a pressure chamber which communicates with a needle valve which is spring biased to block communication between the pressure chamber and a fuel injection nozzle. When the fuel pressure exceeds a value equivalent to the preload of the spring, the pressurized fuel moves the needle valve off its seat so that fuel from the pressure chamber is injected into an engine through the injection nozzle. Further movement of the servo piston unblocks a port to allow fuel at supply pressure to act on the needle valve in the same direction as the spring to sharply seat the needle valve and cleanly terminate fuel injection. Further movement of the servo piston uncovers another port so that the pressure chamber is depressurized through connection with the supply and the needle valve is firmly held on its seat.

20 Claims, 5 Drawing Figures

FUEL INJECTION APPARATUS

Figure 1:
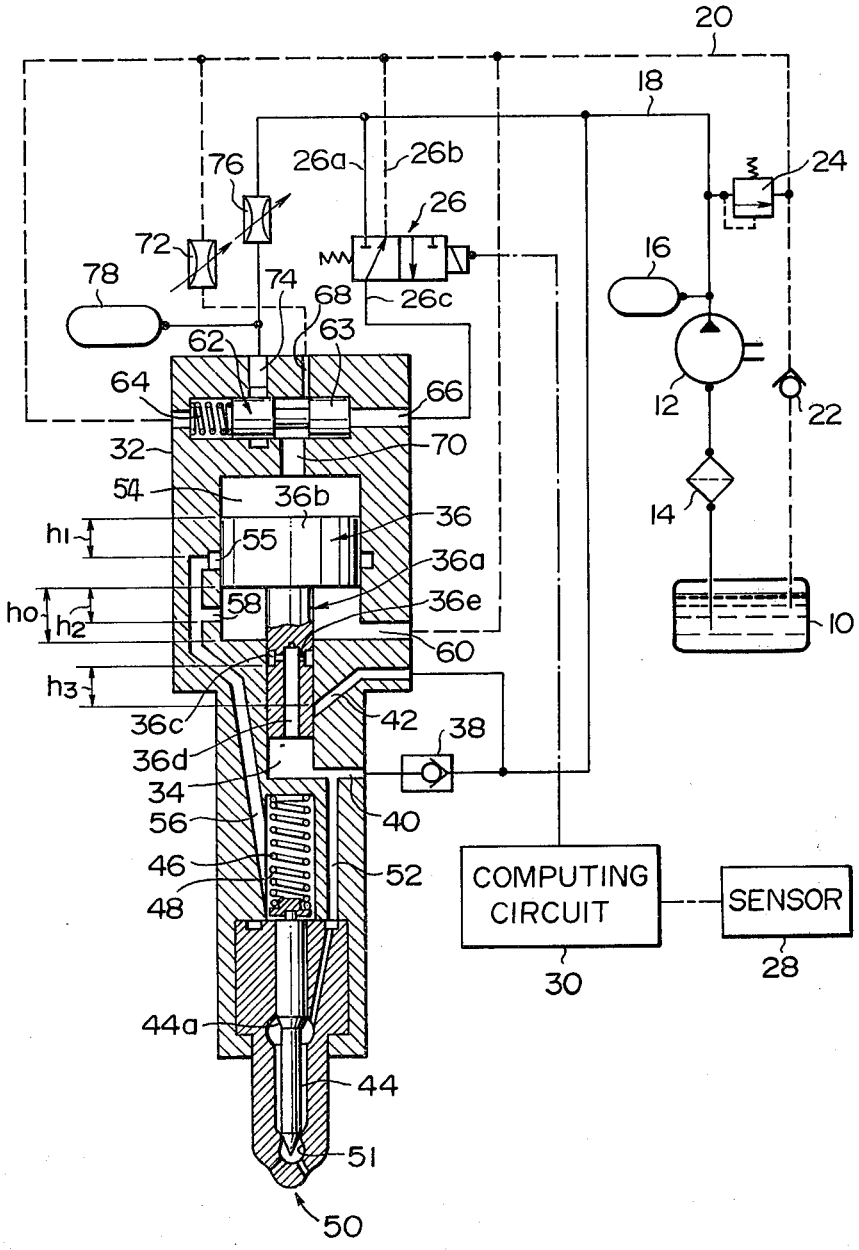

The present invention relates to a fuel injection apparatus for an internal combustion engine or the like which comprises means for cleanly terminating fuel injection.

In a type of fuel injection apparatus such as disclosed in U.S. Pat. No. 2,598,528, a needle valve is urged by a spring to block a fuel injection nozzle. A servo piston is driven to pressurize liquid fuel in a pressure chamber which communicates with the needle valve. When the pressure in the pressure chamber is sufficient to overcome the preload of the spring, the needle valve is forced off its seat and fuel is injected into the engine through the nozzle.

It is important to sharply terminate the fuel injection to eliminate secondary injection which results in inefficient burning of fuel. In the above disclosure it is taught to terminate fuel injection by connecting the pressure chamber to the low pressure fuel supply so that the spring will quickly seat the needle valve. A disadvantage is found in this method when applied to high speed engines in that the needle valve is slammed so sharply onto its seat that it bounces off causing the secondary injection which is to be avoided.

Another method of terminating fuel injection is found in U.S. Pat. No. 3,796,206, which is an improvement to the above patent. In this method, the pressure chamber is connected to an unpressurized fluid reservoir to terminate fuel injection. The needle valve tends to bounce even more sharply off its seat when this method is applied than with the above method since the force differential is greater.

Still another method is disclosed in U.S. Pat. No. 3,810,453, in which a chamber in which the spring is disposed is connected to the pressure chamber to terminate fuel injection in such a manner that the fuel in the spring chamber acts on the needle valve in the same direction as the spring. This method, also, slams the needle valve against its seat so hard that it bounces off causing secondary injection.

It is therefore an object of the present invention to provide fuel injection apparatus which sharply terminates fuel injection and prevents secondary injection.

It is another object of the present invention to provide fuel injection apparatus in which fuel injection is terminated by connecting a spring chamber in which a valve closing spring is disposed to a fuel supply passageway so that the pressurized fuel in the spring chamber acts on the valve in the valve closing direction.

It is another object of the present invention to provide fuel injection apparatus in which fuel injection is terminated by connecting the spring chamber to the fuel supply passageway and subsequently connecting the pressure chamber to the fuel supply passageway so that the fuel injection is terminated in two stages, the valve being closed without bouncing in the first stage and firmly seated in the second stage.

Figure 2A:
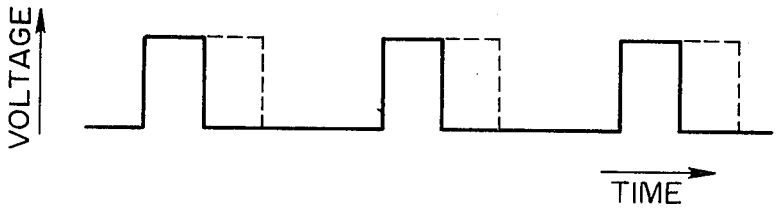
Figure 2B:
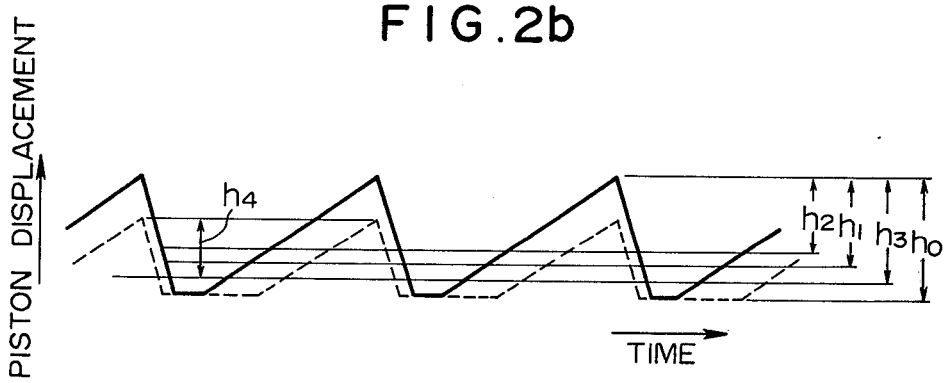
Figure 2C:
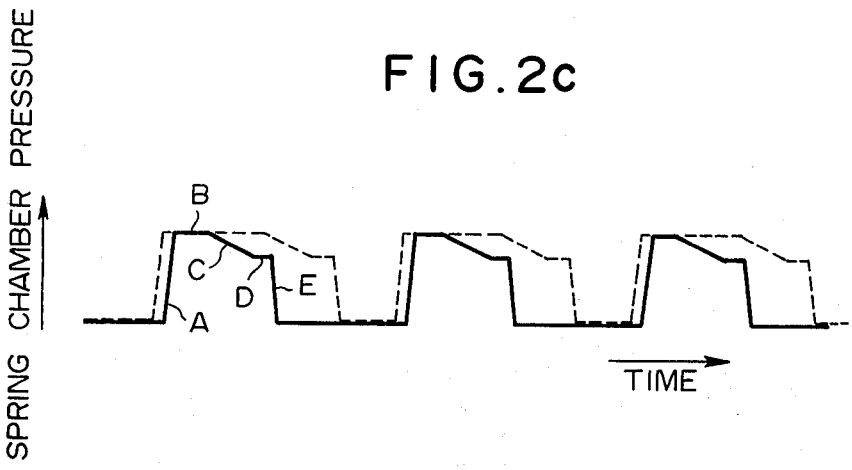
Figure 3:
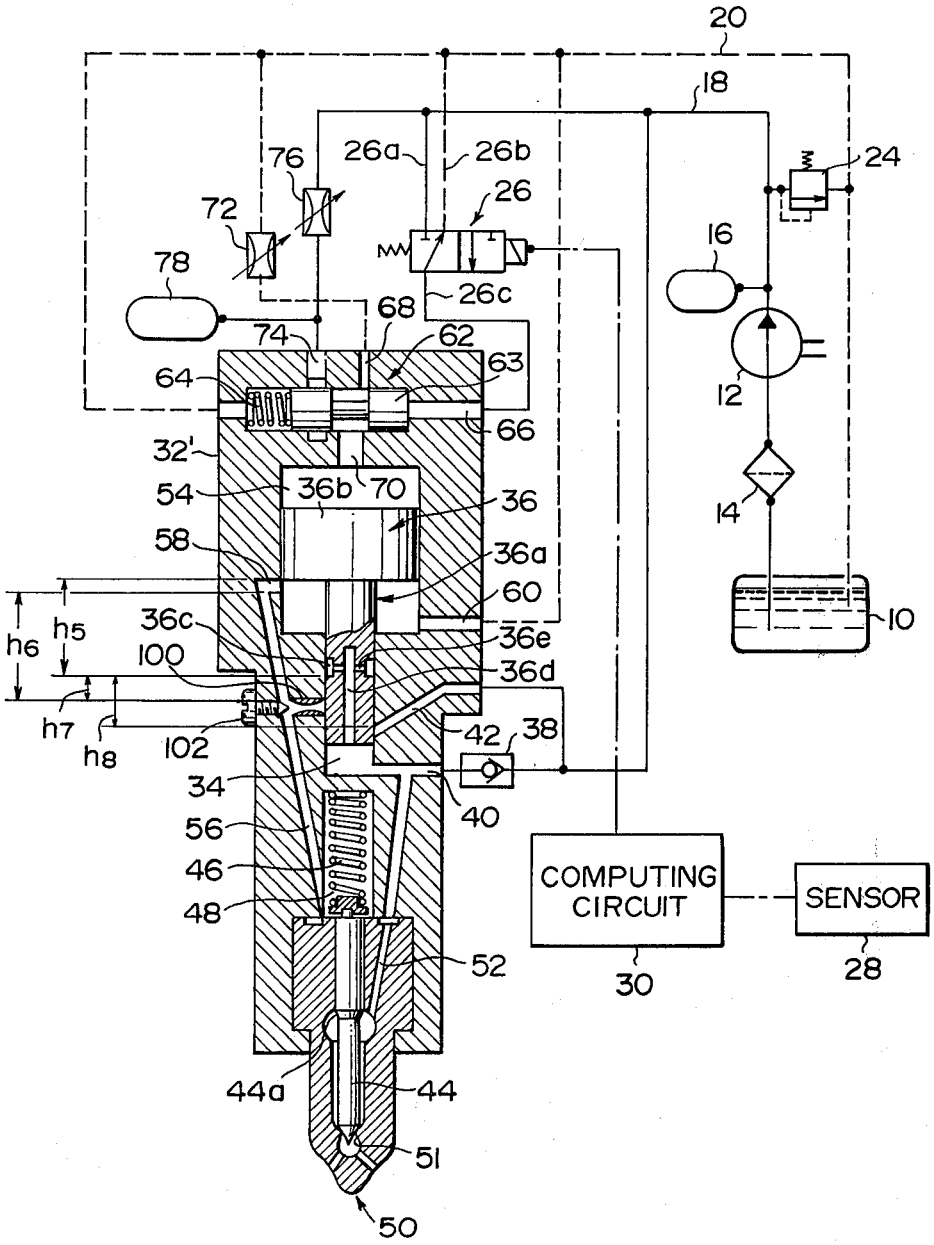

The above and other objects, features and advantages of the present invention will become clear from the following detailed description taken with the accompanying drawings, in which:

FIG. 1 is a schematic cross sectional view of a first embodiment of a fuel injection apparatus embodying the present invention;

FIG. 2*a* is a graph showing electrical control pulses used in the apparatus;

FIG. 2*b* is a graph showing the movement of a servo piston of the apparatus;

FIG. 2*c* is a graph showing fuel pressure in a spring chamber of the apparatus; and FIG. 3 is a schematic cross section showing a second embodiment of a fuel injection apparatus embodying the present invention.

Referring now to FIG. 1, a fuel reservoir or tank 10 is adapted to contain liquid fuel such as Diesel oil. Alow pressure supply pump 12 pumps fuel from the reservoir 10 through a filter 14. An accumulator 16 is provided at the outlet of the pump 12 which is connected to a fuel supply passageway or line 18. A non-pressurized fuel return passageway or line 20 also leads to the tank 10 and is provided with a check valve 22. A pressure regulator valve 24 bypasses excess fuel from the supply line 18 to the return line 20.

An actuator valve 26 is arranged to be electrically operated by means of a sensor 28 and a computing circuit 30 which is responsive to the sensor 28. The sensor 28 is not a novel feature of the invention and may be arranged to sense engine speed and accelerator position and produce a signal representing the difference therebetween, atomspheric temperature and pressure, coolant temperature, and the like in any known manner. The outputs of the sensor 28 are fed to the computing circuit 30 which computes the optimum fuel injection duration in response thereto.

The actuator valve 26 has two inlets 26*a* and 26*b* which are connected to the supply and return lines 18 and 20 respectively. The valve 26 normally connects the inlet 26*b* and thereby the return line 20 to an outlet 26*c* of the valve 26. When an electrical pulse is received from the computing circuit 30, the valve 26 connects the inlet 26*a* and thereby the supply line 18 to the outlet 26*c* for the duration of the pulse.

The fuel injection apparatus of the present invention comprises an injector body 32. A pressure chamber 34 is formed in the body 32 in which is slidable a piston 36, a lower plunger portion 36*a* thereof being sealingly slidable in the pressure chamber 34 so that the volume of the pressure chamber 34 is determined by the position of the plunger portion 36*a*. The supply line 18 is connected to the pressure chamber 34 through an inlet port 40 and a check valve 38 which allows fuel flow only into the pressure chamber 34 from the supply line 18.

The supply line 18 is connected directly to another fuel inlet port 42. The plunger portion 36*a* is formed with an annular groove 36*c* which is arranged to align with the inlet port 42 when the piston 36 is in its lower position. The groove 36*c* communicates with the pressure chamber 34 through an axial passageway 36*d* and radial passageways 36*e*.

A needle valve member 44 is slidable in the body 32 and is biased by a spring 46 disposed in a spring chamber 48 downward to block a fuel injection nozzle 50 formed in a valve seat 51. A passageway 52 connects the pressure chamber 34 to the valve member 44 in such a manner that the pressurized fuel in the passageway 52 communicates with the lower end 44*a* of the valve member 44 and exerts an upward force thereon in opposition to the force of the spring 46. When the force exerted by the fuel on the valve member 44 exceeds the preload of the spring 46, the valve member 44 will be moved upward off the seat 51 and fuel from the passageway 52 will be injected into the engine (not shown) through the nozzle 50.

The body 32 is further formed with a servo chamber 54 in which a servo portion 36b of the piston 36 is sealingly slidable. A spring chamber passageway 56 connects the spring chamber 48 to the servo chamber 54 through upper and lower ports 55 and 58 respectively. The servo portion 36b is arranged to block and unblock the ports 55 and 58 depending on the position thereof. A port 60 at the lowermost portion of the servo chamber 54 is connected to the return line 20.

A spool valve 62 is also provided in the body 32, and has a valve element 63 which is biased rightward by a spring 64. The right end of the valve element 63 is connected to the outlet 26c of the actuator valve 26 through a control port 66. An outlet 700 of the valve 62 is connected to the servo chamber 54 above the servo portion 36b of the piston 36.

The valve 62 has an inlet 68 which is connected through a variable flow restriction 72 to the return line 20 and another inlet 74 which is connected through a variable flow restriction 76 to the supply line 18. It is to be noticeable that the variable flow restriction 72 may serve as a means for controlling fuel injection volume while the variable flow restriction 76 may serve as a means for controlling rate of fueld injection. An accumulator 78 is provided at the inlet 74 to introduce the uniform fuel supply pressure from the supply line 18 into the inlet 74.

In the condition shown in FIG. 1, the fuel injection apparatus has been filled with fuel and is ready for fuel injection. Specifically, the pressure chamber 34 is filled with fuel from the supply line 18 and the bottom of the servo portion 36b of the piston 36 is disposed at a distance $h_O$ from the bottom of the servo chamber 54 (for full load operation). The spring chamber 48 is in communication with the return line 20 through the passageway 56, port 58, lower portion of the servo chamber 54 and the port 60. The pressure in the spring chamber 48 is substantially zero and movement of the servo portion 36b of the piston 36 will not be impaired by fuel in the lower portion of the servo chamber 54.

The computing circuit 30 does not apply a signal to the valve 26, so that the outlet 26c is connected to the inlet 26b as shown. The right side of the valve element 63 of the valve 62 is therefore connected to the non-pressurized return line 20 through the port 66 and valve 26. The spring 64 holds the valve element 63 in its rightmost position in which the inlet 68 communicates with the outlet 70. The return line 20 is therefore connected to the upper portion of the servo chamber 54 through the valve 62. Since there is no pressure in the upper portion of the servo chamber 54 acting downward on the piston 36 and the pressure chamber 34 is filled with fuel at the supply pressure determined by the regulator valve 24 urging the piston 36 upward, the piston 36 will be held in its uppermost position against a stopper (not shown) for full load operation.

The distance which the upper edge of the servo portion 36b must move downward to uncover the port 55 is designated as $h_1$. The distance which the bottom edge of the servo portion 36b must move to cover the port 58 is designated as $h_2$. The distance which the annular groove 36c must move to align and communicate with the port 42 is designated as $h_3$. In this preferred embodiment of the present invention, $h_3$ is greater than $h_1$ which is in turn greater than $h_2$.

To cause the fuel injection apparatus to inject fuel into the engine, the computing circuit 30, in dependence on the rotational position of the engine crankshaft (not shown), applies an electrical pulse to the actuator valve 26 for a duration which is determined by the outputs of the sensor 28. This causes the valve 26 to connect the inlet 26a to the outlet 26c and thereby the supply line 18 to the port 66. The pressurized fuel in the port 66 moves the valve element 63 leftward against the force of the spring 64 so that the inlet 74 communicates with the outlet 70. Fuel at the source pressure is thereby admitted into the servo chamber 54 above the piston 36 through the valve 62. It will be noted that the area of the upper surface of the piston 36 is greater than the area of the lower surface thereof. The fuel admitted into the servo chamber 54 thereby causes the piston 36 to move downward in an injection stroke. It will be noted that during a first portion of the injection stroke, the port 55 is blocked by the servo portion 36b and the port 42 is blocked by the plunger portion 36a of the piston 36.

Downward movement of the piston 36 causes the volume of the pressure chamber 34 to decrease and the pressure of the fuel therein to increase. It will be noted that the fuel is trapped in the pressure chamber 34 by the check valve 38 as soon as the pressure in the pressure chamber 34 slightly exceeds the supply pressure.

The fuel in the passageway 52 is also compressed and acts on the valve member 44 in the upward direction against the force of the spring 46. As soon as this force exceeds the preload of the spring 46, the valve member 44 will be moved off its seat 51 so that fuel from the passageway 52 will be injected into the engine through the nozzle 50.

A second portion of the injection stroke occurs when the servo portion 36b covers the port 58. The spring chamber 48 is thereby disconnected from the return line 20. Further movement of the piston 36 causes the servo portion 36b to uncover the port 55 thereby connecting the spring chamber 48 to the supply line 18 through the servo chamber 54 and valve 62. The fluid pressure in the spring chamber 48 acts on the valve member 44 in the same direction as the spring 46 and causes the valve member 44 to seat and terminate fuel injection against the force of the fuel in the passageway 52. Further movement of the piston 36 results in a third portion of the injection stroke in which the groove 36c uncovers the port 42. The pressure chamber 34 is thereby connected to the supply line 18 through the passageways 36d and 36e, groove 36c and port 42. This causes the pressure in the pressure chamber 34 to quickly fall to the supply pressure so that the valve member 44 is firmly held on its seat 51 to prevent bouncing and resulting secondary injection. The distances $h_1$ and $h_3$ may be selected for timing in such a manner that the time the groove 36c uncovers the port 42 coincides with the time that the impact force of the needle valve member 44 on its seat 51 urges the valve member 44 to bounce.

When the pulse from the computing circuit 30 is terminated, the valves 26 and 62 are actuated to connect the upper portion of the servo chamber 54 to the return line 20. The piston 36 is moved upward in an inlet stroke by the pressure in the pressure chamber 34. The plunger portion 36a covers the port 42 so that the pressure chamber 34 is filled with fuel through the check valve 38 and port 40. The servo portion 36b covers the port 55 to disconnect the spring chamber 48 from the supply line 18. The servo portion 36b then uncovers the port 58 so that the spring chamber 48 is connected to the return line 20 and depressurized. When the piston 36 reaches its upper limit of travel the fuel injection apparatus is ready to again inject fuel into the engine.

FIGS. *2a, 2b* and *2c* illustrate the electrical pulses from the computing circuit 30, the displacement of the piston 36 from its lowermost position and the pressure in the spring chamber 48 as functions of time. These figures also illustrate the manner in which the fuel injection volume is controlled by the length of the electrical pulses, as will be described in detail below. The solid line curves represent operation for maximum (full load) fuel injection volume and the broken line curves represent operation for a fuel injection volume less than maximum. In both case the duration of the pulses is sufficient for the servo portion **36*b* of the piston 36 to bottom against the lower surface of the servo chamber 54 during the injection stroke. To decrease the fuel injection volume, the duration of the pulses is increased by a suitable amount so that the time between the falling edge of one pulse when the piston 36 is released from its lowermost position and the rising edge of the next pulse when the piston 36 is driven downward is not sufficient for the piston 36 to travel the distance $h_0$. Rather, the piston 36 movement is reversed to begin the injection stroke when the piston 36 has travelled a distance $h_4$ from its lowermost position which is less than $h_0$. Since the effective volume of the pressure chamber 34** is less at the position $h_4$ that at the position $h_0$, the fuel injection volume is decreased.

In FIG. *2c*, a curve portion (A) represents the increase in spring chamber 48 pressure when the servo portion **36*b* uncovers the port 55. A curve portion (B) shows that the pressure is unchanged during the time the piston 36 is in its lowermost position. A curve portion (C) represents a pressure drop caused by connecting the servo chamber 54 to the return line 20 through the valve 62 and flow restriction 72 to initiate the inlet stroke. A curve portion (D) shows that the pressure is unchanged during a portion of the inlet stroke in which both the ports 55 and 58 are covered by the servo portion 36*b*, and a curve portion (E) illustrates a pressure drop down to zero pressure which occurs when the servo portion 36*b* uncovers the port 58**.

Another embodiment of the present invention is illustrated in FIG. 3, which is similar to the embodiment of FIG. 1, and like elements are designated by the same reference numerals.

A body 32' is modified in such a manner as not to comprise the port 55. Instead, a constricted port 100 communicates with the passageway 56 at a distance such that the groove **36*c* uncovers the port 100 when the piston 36 is moved away from its uppermost position. The spring chamber 48 is connected in this manner to the pressure chamber 34 through the axial passageway 36*d*, radial passageways 36*e*, groove 36*c*, port 100 and passageway 56 so that the increased high pressure in the pressure chamber 34 is applied to the spring chamber 48. Further dowanward movement of the piston 36 causes the groove 36*c* to also uncover the port 42 so that both the pressure chamber 34 and the spring chamber 48 are connected to the supply line 18. In this embodiment of the present invention, a distance designated as $h_6$ is greater than a distance designated as $h_5$, while a distance designated as $h_8$ is greater than a distance designated as $h_7$. The port 100 is constricted to prevent the pressure in the spring chamber 48 from rising excessively quickly. A screw 102 is provided to adjust the amount of constriction of the port 100**.

Many modifications to the present invention within the scope thereof will become possible for those skilled in the art after receiving the teachings of the present disclosure. For example, the port 100 may, if desired, be located at the same position as the port 42 so that the groove **36*c* uncovers the ports 100 and 42 at the same time. In this manner, the spring chamber 48 will not be exposed to the high pressure in the pressure chamber 34**.

What is claimed is:

1. A fuel injection apparatus comprising:

a body;

a piston member slidable in the body to define therewith a variable volume pressure chamber;

an injection valve means exposed to a fuel pressure in the pressure chamber and slidable in the body to control communication between the pressure chamber and a fuel injection nozzle;

the body further defining a spring chamber communicating with the injection valve member;

a spring disposed in the spring chamber urging the injection valve member to block communication between the pressure chamber and the fuel injection nozzle;

drive means to move the piston member in an inlet stroke to increase a volume of the pressure chamber and in an injection stroke to decrease the volume of the pressure chamber;

first valve means to communicate the pressure chamber with a fuel supply passageway during the inlet stroke;

the fuel pressure in the pressure chamber increasing during a first portion of the injection stroke so as to move the injection valve member against a force of the spring to communicate the pressure chamber with the fuel injection nozzle;

second valve means to communicate the spring chamber with the fuel supply passageway during a second part of the injection stroke so that a fuel pressure in the spring chamber acts on the valve member in a same direction as the force of the spring;

third valve means to communicate the spring chamber with a fuel return passageway during the inlet stroke; and fourth valve means to communicate the pressure chamber with the fuel supply passageway during a third portion of the injection stroke.

2. The apparatus according to claim 1, in which the second valve means comprises the piston member and a spring chamber passageway formed through the body and communicating with the spring chamber, the piston being arranged to control communication between the fuel supply passageway and the spring chamber passageway.

3. The apparatus according to claim 2, in which the piston member is formed with a piston member passageway, the spring chamber communicating with the fuel supply passageway through the piston member passageway.

4. The apparatus according to claim 3, in which the spring chamber passageway is formed with a flow restriction.

5. The apparatus according to claim 3, in which the first valve means comprises the piston member passageway.

6. The apparatus according to claim 1, in which the first and second valve means are integral.

7. The apparatus according to claim 2, in which the third valve means comprises the piston member and a second spring chamber passageway formed through the body.

8. The apparatus according to claim 1, in which the body further defines a servo chamber, a servo portion of the piston member being sealingly slidable in the servo chamber.

9. The apparatus according to claim 8, in which the second valve means comprises the servo portion of the piston member and a spring chamber passageway formed through the body and communicating with the spring chamber, the spring chamber passageway opening into the servo chamber and the fuel supply passageway being communicable with the servo chamber, the servo portion of the piston member being arranged to block and unblock the spring chamber passageway.

10. The apparatus according to claim 9, in which the drive means comprises drive valve means to selectively communicate the servo chamber with the fuel supply passageway and with the fuel return passageway.

11. The apparatus according to claim 10, in which the drive means further comprises electric actuator means to actuate the drive valve means.

12. The apparatus according to claim 11, in which the electric actuator means comprises sensor means and fuel injection duration computing means responsive to the sensing means.

13. The apparatus according to claim 1, in which the first valve means comprises a first inlet passageway communicating with the feul supply passageway and opening into the pressure chamber and a check valve to allow fuel flow only from the fuel supply passageway into the pressure chamber through the first fuel inlet.

14. The apparatus according to claim 13, further comprising fourth valve means to communicate the pressure chamber with the fuel supply passageway during a third portion of the injection stroke.

15. The apparatus according to claim 10, in which the fourth valve means comprises a piston member passageway formed through the piston member and communicating with the pressure chamber and a second fuel inlet communicating with the fuel supply passageway, an opening of the piston member passageway being arranged to communicate with an opening of the second fuel inlet during the third portion of the injection stroke.

16. The apparatus according to claim 3, in which the piston member passageway communicates with the pressure chamber.

17. The apparatus according to claim 16, in which the second valve means is arranged to communicate the spring chamber with the pressure chamber before communicating the spring chamber with the fuel supply passageway.

18. The apparatus according to claim 10, in which the servo chamber is communicated through first and second variable flow restrictions with the fuel supply passageway and the fuel return passageway respectively.

19. The apparatus according to claim 18, in which the first variable flow restriction functions to control rate of fuel injection and the second variable flow restriction functions to control fuel injection volume.

20. The apparatus according to claim 18, in which an accumulator is provided to introduce uniform fuel supply pressure from the fuel supply passageway into the servo chamber.

* * * * *